US006409326B1

(12) United States Patent
Giles et al.

(10) Patent No.: US 6,409,326 B1
(45) Date of Patent: Jun. 25, 2002

(54) DIGITAL PRINT HEAD

(75) Inventors: Christopher Michael Giles, Foster City, CA (US); Anthony Lawrence, Potters Bar (GB)

(73) Assignee: Neopost Limited, Essex (GB)

( * ) Notice: Subject to any disclaimer, the term of this patent is extended or adjusted under 35 U.S.C. 154(b) by 0 days.

(21) Appl. No.: 09/697,642

(22) Filed: Oct. 27, 2000

(30) Foreign Application Priority Data

Oct. 29, 1999 (GB) ..... 9925637

(51) Int. Cl.[7] ..... B41J 2/175
(52) U.S. Cl. ..... 347/87; 347/50
(58) Field of Search ..... 347/37, 49, 50, 347/87, 108

(56) References Cited

U.S. PATENT DOCUMENTS 5,548,311 A 8/1996 Hine ..... 347/50
5,623,293 A 4/1997 Aoki ..... 347/50
5,835,111 A 11/1998 Balazer ..... 347/50
5,861,897 A 1/1999 Ide et al. ..... 347/19
6,238,038 B1 * 5/2001 Gilham et al. ..... 347/49

* cited by examiner

*Primary Examiner*—Anh T. N. Vo
(74) *Attorney, Agent, or Firm*—Shoemaker and Mattare

(57) ABSTRACT

An ink jet print head includes an ink jet print module contained in a cartridge housing. The ink jet print module includes a surface containing a plurality of ink jet nozzles and this surface extends in a aperture of the cartridge housing. An element extends from the housing and supports a set of electrical terminals and electrical connection means provide electrical interconnections between electrical contacts of the set of electrical contacts of the ink jet print module and electrical terminals of the set of electrical terminals supported in the element.

8 Claims, 3 Drawing Sheets

DIGITAL PRINT HEAD

BACKGROUND OF THE INVENTION

This invention relates to digital print heads and in particular to ink jet print head cartridges and to housing and the provision ofexternal electrical connections therefor.

Ink jet print head cartridges or modules are known in which a casing houses a plurality of ink jet nozzles from which droplets of ink may be ejected selectively as required by ink ejection means and electronic circuits for controlling operation of the ink ejection means. One known form of ink jet print head includes, for each ink ejection nozzle, an ink chamber communicating with the ink ejection nozzle and a resistive element for heating the ink in the ink chamber so as to eject a droplet of ink from the nozzle. A pulse of electrical current is passed through the resistive element to cause the required heating of the ink in the associated ink chamber. Electronic driver circuits of the print head control generation of the pulse of electrical current. The driver circuits are controlled by print control signals generated externally of the print head module by electronic control circuits operating to cause ejection of ink droplets selectively in a sequence of printing cycles from selected ones of the nozzles such as to produce a required imprint on a print receiving medium.

The ink jet print head module includes a reservoir of ink and, as ink is ejected in droplets from the nozzles during operation of the print head, the ink in the reservoir is gradually depleted. In known commercially available ink jet print head modules, when the ink in the reservoir has been depleted to a low level the entire module is replaced by a new module containing a reservoir full of ink. Accordingly the module is constructed to be readily removable and replaceable by a user of printing apparatus incorporating such ink jet print modules. The module is provided with a set of electrical contacts which, when the module is removably mounted in the printing apparatus, engage with a corresponding set of electrical contacts of the printing apparatus to connect the external control circuits to the driver circuits of the print head module.

In one commercially available ink jet print module, the nozzles of the print head are located in a first planar face of the module and the set of electrical contacts is located on an adjacent face extending substantially perpendicular to the first face. While this construction and relative location of the nozzles and of the set of electrical contacts is satisfactory in many constructions of printing apparatus, it does impose restrictions on the construction of the printing apparatus with regard to the insertion into and removal from the printing apparatus of the print head modules.

Generally the commercially available print head modules are used in non-secure printers for example output printers connected to and operated by personal computers. However it is also proposed to use commercially available ink jet print head modules in postage meters for printing postal indicia on mail pieces. It will be appreciated that because postage meters are used to dispense postage value it is required that the print head is operated in a secure manner and postal authorities may require use of an ink that is different from inks used in print head modules used generally for other purposes. Accordingly it is desired to ensure that only authorised print head modules are utilised in the postage meter.

SUMMARY OF THE INVENTION

According to the invention an ink jet printhead includes an ink jet print module and a cartridge housing; said ink jet print module including a plurality of ink jet nozzles in a first exterior surface of said module; selectively operable driver means to eject ink from selected ones of said nozzles and a set of electrical contacts connected to said driver means and located on a second exterior surface of the module; said ink jet print module being housed in said cartridge housing; said cartridge housing including a wall and an aperture in said wall through which said first surface extends so that said ink jet nozzles are located exterior to the housing; an element extending from said housing and supporting a set of electrical terminals; and electrical connection means providing electrical interconnections between electrical contacts of said set of electrical contacts and electrical terminals of said set of electrical terminals.

Preferably the electrical terminals are located on a printed circuit board, said printed circuit board extending from the element into the interior of the housing; said printed circuit board being provided with a set of electrical contact pads corresponding to said electrical contacts of the print head module, the electrical contact pads respectively being in electrical contact engagement with corresponding ones of the electrical contacts and the printed circuit board includes electrical tracks extend interconnecting the electrical terminals and the electrical contact pads.

If desired the terminals may be connected respectively to correspondingly located electrical contacts of the print head module or at least some of the terminals may be connected to electrical contacts of the print head module that are not located corresponding to the terminals.

The housing may have a planar side wall and the element supporting the terminals may extend substantially perpendicular to the planar side wall.

BRIEF DESCRIPTION OF THE DRAWING

An embodiment of the invention will now be described by way of example with reference to the drawings in which.

DESCRIPTION OF THE PREFERRED EMBODIMENT

Figure 1:
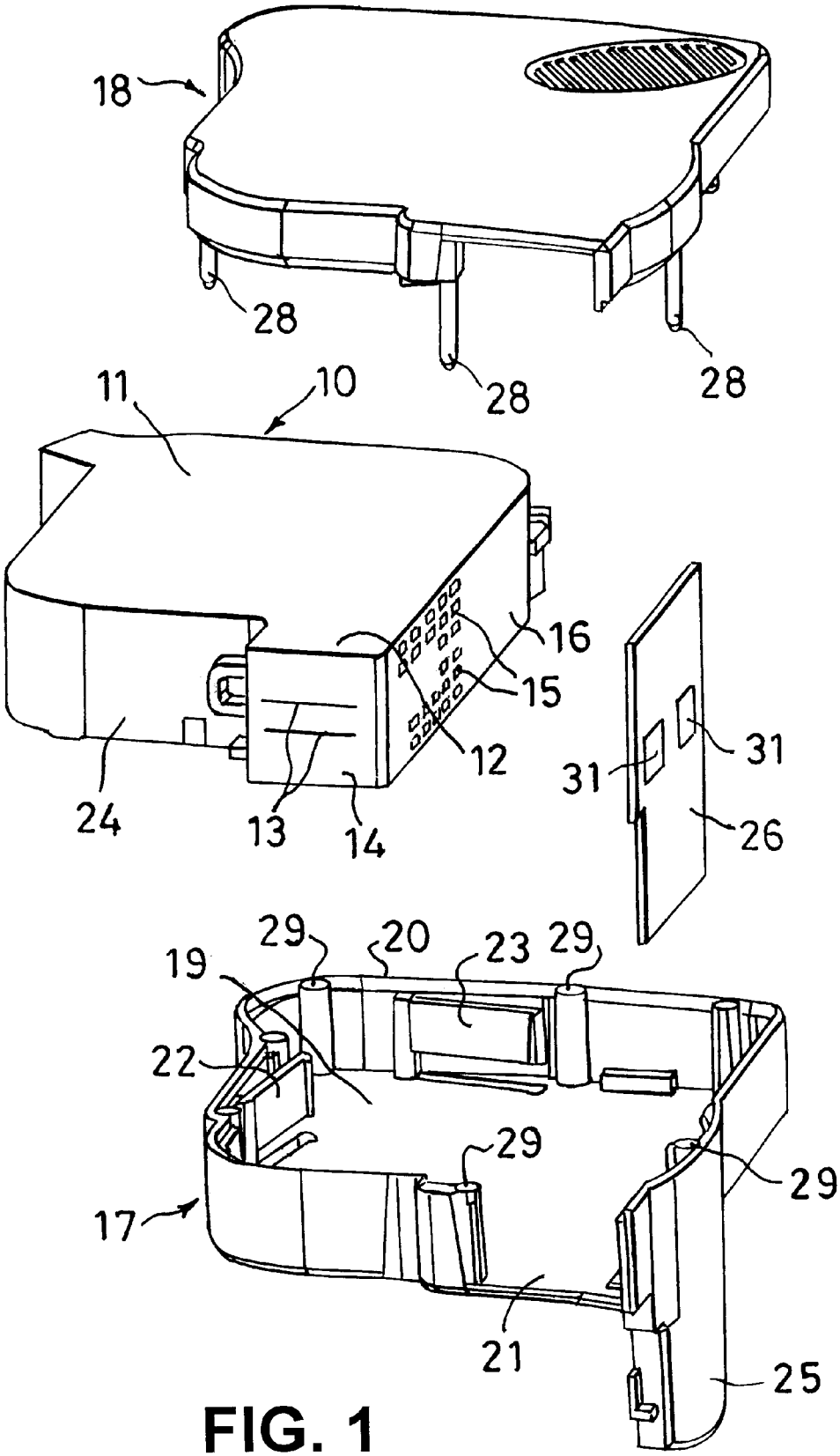
FIG. 1 is a view of a print head module and components of a housing therefor prior to assembly of the housing.

Referring first to FIG. 1 of the drawings, a known commercially available ink jet print head module 10 consists of a main body 11 and a projection 12 extending from the main body. Two rows of ink jet nozzles 13 are located in a face 14 of the projection 12. A set of electrical contacts 15 are located on a face 16 of the main body 11. It will be understood that the sets of electrical contacts comprise a plurality of individual contacts but for clarity in the drawings only a small number of contacts are shown by way of illustration.

Figure 2:
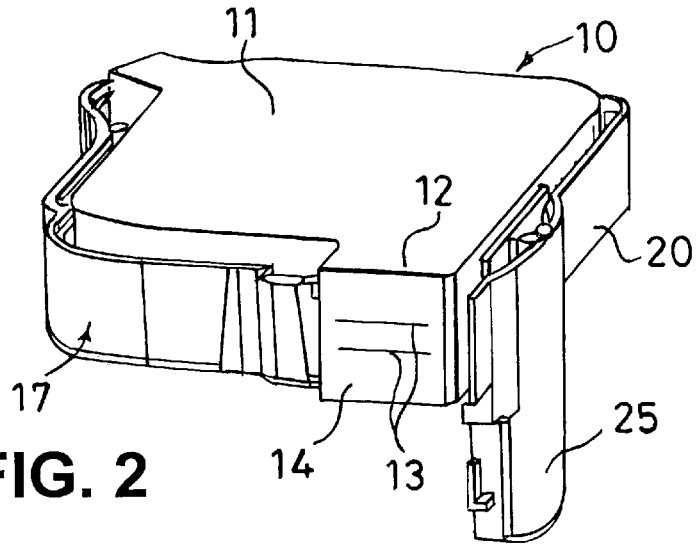
FIG. 2 illustrates the print head module inserted in a body component of the housing.
Figure 3:
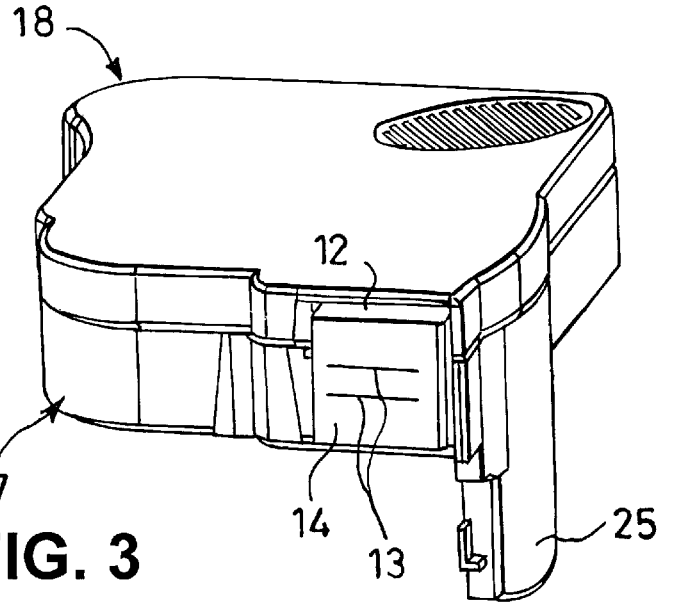
FIG. 3 illustrates the assembled housing with the print head module therein.
Figure 4:
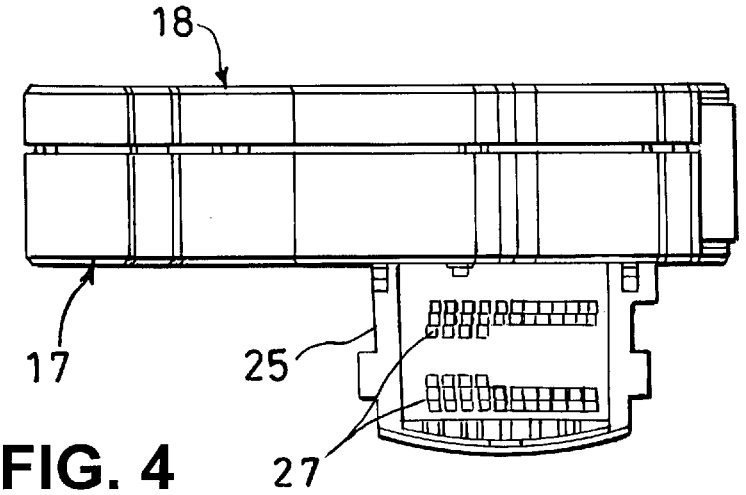
FIG. 4 is an end elevation view of the assembled housing.
Figure 5:
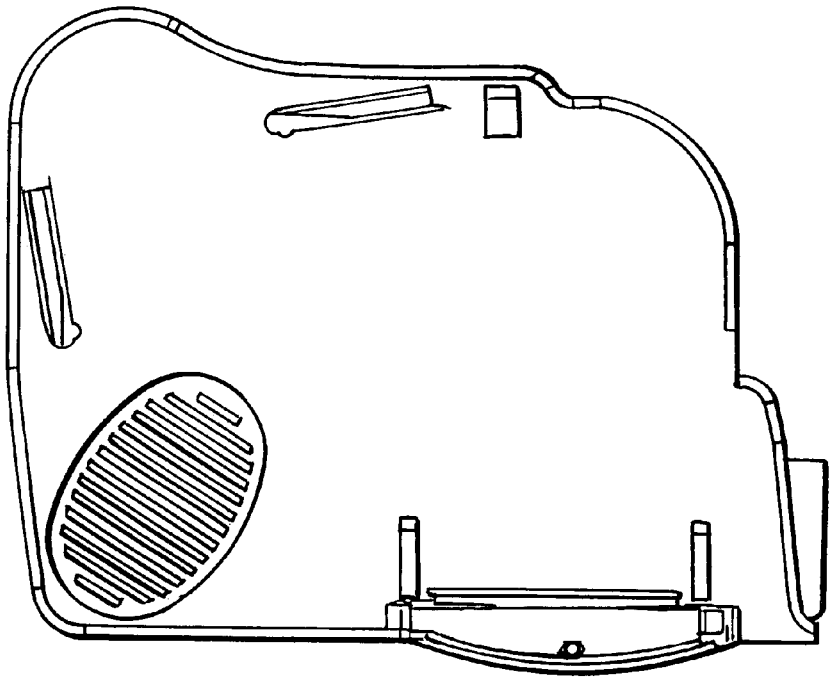
FIG. 5 is a side elevation view of the assembled housing.
Figure 6:
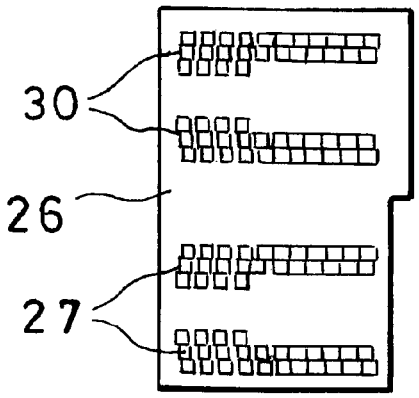
FIG. 6 illustrates a printed circuit component with sets of electrical contacts thereon.

A housing for the module 10 comprises a body component 17 and a cover component 18. The body component 17 has a side wall 19 and a peripheral wall 20 extending from the side wall 19 to accommodate the print head module 10 as shown in FIG. 2. The peripheral wall 20 has an aperture 21 therein through which the projection 12 of the print head module extends (see FIG. 2) so that the face 14 and nozzles 13 are located to the exterior of the housing. Resilient members 22 and 23 are provided in the body component and act on the print head module to locate the face 16 and a face 24 of the print head module in abutment with corresponding parts of the peripheral wall and thereby define the location of the print head module within the housing. The body component is provided with an extension 25 extending from the side wall 19 in a direction opposite to that of the peripheral wall 20. A printed circuit board 26 is located in the extension 25 and has a set of electrical contact pads 30 (FIG. 6) corresponding to the set of electrical contacts 15 of the print head module. The contact pads 30 of the printed circuit board 26 oppose the contacts 15 of the print head module and respective ones of the contact pads 30 are opposed to and make electrical connection to corresponding ones of the electrical contacts 15. It is preferred to bond the contacts 30 of the printed circuit board to the contacts 15 of the print head module for example by solder bonds to provide reliable electrical interconnections between the print head module and the printed circuit board. However if desired the action of the resilient member 22 on the print head module may be utilised to urge the contacts 15 into engagement with the contact pads of the printed circuit board whereby the contacts 15 are connected electrically to the printed circuit board. The printed circuit board is also provided with a set of electrical terminals 27 (FIG. 4). The terminals 27 are connected by conductive tracks (not shown) respectively to corresponding ones of the electrical contact pads 30 of the circuit board and hence, through the engagement between the electrical contact pads of the circuit board with the contacts 15 of the module, the terminals 27 are connected to the electrical contacts 15 of the print head module.

When the printed circuit board 26 is located in the base component 17 and the print head module has been inserted the base component as hereinbefore described, the over component 18 is secured to the base component. Conveniently the cover component may be secured to the base component by means of studs 28 extending from the cover and entering in corresponding bores 29 in the base component. The studs are an interference fit in the bores and hence when the cover is pressed into position on the base component with the studs entering the bores, the interference fit of the studs in the bores retains the cover on the base component and the base and cover provide a sealed housing for the print head module. Preferably the construction of the studs is such that if an attempt is made to remove the cover from the base the studs fracture and thereby prevent replacement of the cover. The fracture of the studs provides an indication that tampering has occurred and probably that the tampering was an attempt to interfere with or replace the print head module with an unauthorised print head module.

It will be appreciated that, by location of the print head module within the sealed housing and by constructing printing apparatus in which the print head module is to be used such that only a print head module located within the sealed housing can be operationally received in the apparatus, only authorised print head modules located in the sealed housing can be used in the printing apparatus.

In addition, by locating the print head module in a housing with external electrical connections provided by terminals 27 on the printed circuit board 25, the external electrical connections may be provided at a location that is convenient for the particular printing apparatus in which the print head module is to be used. In the embodiment described hereinbefore the external electrical terminals 27 are offset sideways relative to the print head module. However it will be appreciated that the location of the electrical terminals 27 relative to the trical contacts 15 of the print head module may be different from that of the embodiment described hereinbefore and may be chosen for convenience of insertion and removal of the print head module in the housing to and from the particular printing apparatus.

The configuration of the electrical terminals 27 may be the same as the configuration of the electrical contacts 15 and the terminals 27 may be connected on a one-to-one basis to correspondingly located electrical contacts 15. However where it is desired to prevent operation of the print head module by electrical signals applied to a configuration of electrical contacts corresponding to the electrical contacts 15, the interconnections between the terminals 27 and the electrical contacts 30 of the printed circuit board 26 may be interchanged thereby providing a simple coding of the signals to the print head module. For example suppose that there are 1 to n electrical contacts 15 and corresponding contact pads 30, 1 to n terminals 27 and that electrical contact $\mathbf{15}_1$ of the print head is opposed to contact pad $\mathbf{30}_1$ of the printed circuit board 26 and is connected to terminal $\mathbf{27}_8$ and, in a similar manner electrical contact $\mathbf{15}_5$ is connected to terminal $\mathbf{27}_1$. If operation of a first nozzle requires an input signal on electrical contact $\mathbf{15}_1$ and operation of an eighth nozzle requires an input on electrical contact $\mathbf{15}_8$, then an input must be applied to terminal $\mathbf{27}_8$ in order to operate the first nozzle and an input on terminal $\mathbf{27}_1$ to operate the eighth nozzle. However if in tampering with the print head module a signal is applied to terminal number 1 as might be expected from the configuration of contact 15 on a standard print head module to operate the first nozzle, the first nozzle will not be operated but instead the eighth nozzle will be operated. Accordingly it will be appreciated that inputs to the terminals of signals configured to operate a standard print head will result in a corrupted image being printed and that in order to print a required image using the print head module contained within the sealed housing it is necessary for the signals to be configured to correspond to the connections of the terminals to the contacts 15. Also if desired the printed circuit board may incorporate active electrical circuits 31 connected between the terminals 27 and the contact pads 30 and operative to modify electrical signals applied to the terminals 27. The active circuits may include one or more inverters and may include one or more gate circuits. The effect of providing these active circuits is that signals applied to the terminals 27 which would be expected to operate the print head module if applied directly to the electrical contacts 15 are ineffective to operate the print head module in the desired manner. In order to operate the print head module in the desired manner, signals must be applied to the terminals 27 which, when modified by the active circuits, produce electrical signals at the electrical contacts 15 to operate the print head module as desired.

We claim:

1. An ink jet print head, including:

an ink jet print module, said module including a plurality of ink jet nozzles in a first exterior surface of said module, selectively operable drivers for ejecting ink from selected ones of said nozzles, and a set of electrical contacts connected to said drivers and located on a second exterior surface of said module;

a housing in which said module is housed, said housing including a wall, an aperture in said wall through which said first exterior surface of said module extends such that said nozzles are located exterior to said housing, and a projection extending outwardly and supporting a set of electrical terminals; and an electrical connection unit providing electrical connections between electrical contacts of said set of electrical contacts and electrical terminals of said set of electrical terminals.

2. An ink jet print head as claimed in claim 1, wherein said electrical connection unit comprises a printed circuit board, said printed circuit board extending from said projection and interior of said housing, carrying said set of electrical terminals, and including a set of electrical contact pads corresponding to said set of electrical contacts and electrical tracks interconnecting said set of electrical terminals and said set of electrical contact pads, said electrical contact pads of said set of electrical contact pads being in electrical contact engagement with corresponding ones of said electrical contacts of said set of electrical contacts.

3. An ink jet print head as claimed in claim 1, wherein said electrical contacts of said set of electrical contacts are located in a first configuration, said electrical terminals of said set of electrical terminals are located in a second configuration corresponding to said first configuration, and said electrical terminals of said set of electrical terminals are located in positions in said second configuration corresponding to positions in said first configuration of said electrical contacts to which said electrical terminals are connected.

4. An ink jet print head as claimed in claim 1, wherein said set of electrical contacts are located in a first configuration, said set of electrical terminals are located in a second configuration corresponding to said first configuration, and at least some of said electrical terminals of said set of electrical terminals are located in positions in said second configuration not corresponding to positions in said first configuration of said electrical contacts to which said electrical terminals are connected.

5. An ink jet print head as claimed in claim 1, wherein at least one of said connections between said set of electrical terminals and said set of electrical contact pads includes an active electronic circuit operative to modify signals passing between at least one of said electrical terminals of said set of electrical terminals and at least one of said electrical contact pads of said set of electrical contact pads.

6. An ink jet print head as claimed in claim 1, wherein said set of electrical contacts have a first orientation permitting electrical engagement therewith from a first direction and said set of electrical terminals have a second orientation permitting electrical engagement therewith from a second direction opposite to said first direction.

7. An ink jet print head as claimed in claim 1, wherein said first and second exterior surfaces of said module are substantially mutually perpendicular, said housing includes a side wall extending substantially perpendicular to said first and second exterior surfaces, and said projection extends in a third direction substantially perpendicular to said side wall such that said set of electrical terminals are disposed in a location offset from said side wall.

8. An ink jet print head as claimed in claim 1, wherein said housing comprises first and second members, and said module is secured in said housing by inter-connection of said first and second members, with said interconnection of said first and second members being by frangible connections that fracture in any tampering action in attempting to separate said first and second members.

* * * * *